United States Patent [19]

Bailey

[11] 4,196,904

[45] Apr. 8, 1980

[54] BOARD GAME

[76] Inventor: Patrick E. Bailey, 14401 Villa Woods Pl., Pacific Palisades, Calif. 90272

[21] Appl. No.: 929,858

[22] Filed: Jul. 31, 1978

[51] Int. Cl.[2] ..... A63F 3/00

[52] U.S. Cl. ..... 273/256

[58] Field of Search ..... 273/256, 254, 247, 278, 273/243

[56] References Cited

U.S. PATENT DOCUMENTS

| | | | |
|---|---|---|---|
| 3,990,707 | 11/1976 | Terilli | 273/256 |
| 4,087,094 | 5/1978 | Bakay | 273/254 |
| 4,094,509 | 6/1978 | Barron | 273/247 |

FOREIGN PATENT DOCUMENTS

| | | | |
|---|---|---|---|
| 801964 | 9/1958 | United Kingdom | 273/243 |

OTHER PUBLICATIONS

*100th Anniversary Game Catalog,* Selchow & Righter, Bayshore, N.Y.; 3/14/68 pp. 24, 25.

*Primary Examiner*—Richard C. Pinkham
*Assistant Examiner*—Scott L. Brown
*Attorney, Agent, or Firm*—Jessup & Beecher

[57] ABSTRACT

A board game is provided which involves competition between the players to achieve a particular status level, the first player to achieve the particular status level being the winner. The board has marked squares which constitute a path extending around its periphery. Status cards, Bank cards and Jet Set cards are provided, each with specific instructions and each designating status points gained or lost by the selection of the particular card. Gold Street areas, each including a group of exclusive retail stores, are provided on the board, and when a particular store in such an area is entered, the needle on a status wheel is spun which refers the player to a number in an indexed booklet which, in turn, designates the purchase to be made in the particular store. Status cars may be purchased at car dealerships within the Gold Street areas, and these may be traded in for higher status cars.

7 Claims, 5 Drawing Figures

STATUS CARDS

12

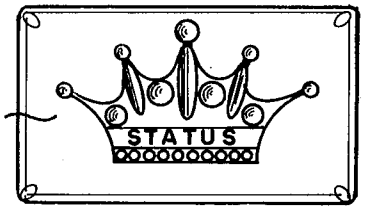

YOU SERVE AN "INFORMAL" DINNER FOR TWELVE USING STERLING SILVER, LIMOGES CHINA AND BACCARAT CRYSTAL.

GAIN 20 POINTS

LUNCH WITH STUDIO EXECUTIVES AT LA SCALA. EITHER PICK UP CHECK AND LOSE $300.00-OR, LET THEM PAY AND LOSE 20 POINTS.

WHILE AT GUCCI, YOU ASKED FOR CHANGE FOR THE PARKING METER.

LOSE 10 POINTS

YOU'VE JUST BEEN INVITED TO A "SWIM IN" AT THE PLAYBOY MANSION

GAIN 20 POINTS

THE HEAD OF PARAMOUNT CALLS AND ASKS YOU TO ATTEND A SCREENING OF HIS LATEST FILM.

GAIN 20 POINTS

YOU WERE SEEN STANDING IN LINE AT JURGENSON'S TALKING TO STEVE McQUEEN.

GAIN 30 POINTS

YOU LEAVE THE PREMIERE IN A DAZZLE OF SEQUINS AND LIGHTS-BUT YOUR LIMO IS NOT WAITING... YOUR TAXI IS.

LOSE 20 POINTS

YOU'VE BEEN CHOSEN AS ONE OF THE SELECT GUCCI SHOPPERS TO BE GRANTED A "GOLD KEY" TO LA GALERIA. GO TO GUCCI IMMEDIATELY AND GAIN 100 POINTS

YOU SHIP YOUR MERCEDES TO GERMANY FOR A LUBE... LOSE ONE TURN WHILE CAR IS OUT OF COUNTRY, BUT...

GAIN 20 POINTS!

YOU ASK CLERK AT VAN CLEEF & ARPELS FOR "SIMULATED" PEARLS!

GO TO VALLEY!!!

YOU ORDER ENGRAVED INVITATIONS FOR YOUR GARDEN PARTY AND HAVE THEM HAND-DELIVERED WITH A SINGLE RED ROSE

GAIN 20 POINTS

YOU ASK THE HOST TO POUR 7-UP INTO YOUR CHATEAU LAFITE ROTHCHILD BECAUSE YOU LIKE "WINE COOLERS"!

GO TO VALLEY!!!

YOU WERE SEEN GETTING OFF A BUS!

GO TO VALLEY AND LOSE 20 POINTS!

FIG. 5

BOARD GAME

BRIEF DESCRIPTION OF THE DRAWINGS

FIG. 5 is a collection of Status cards, with typical information which appears on such cards.

DETAILED DESCRIPTION OF THE ILLUSTRATED EMBODIMENT

Figure 1:
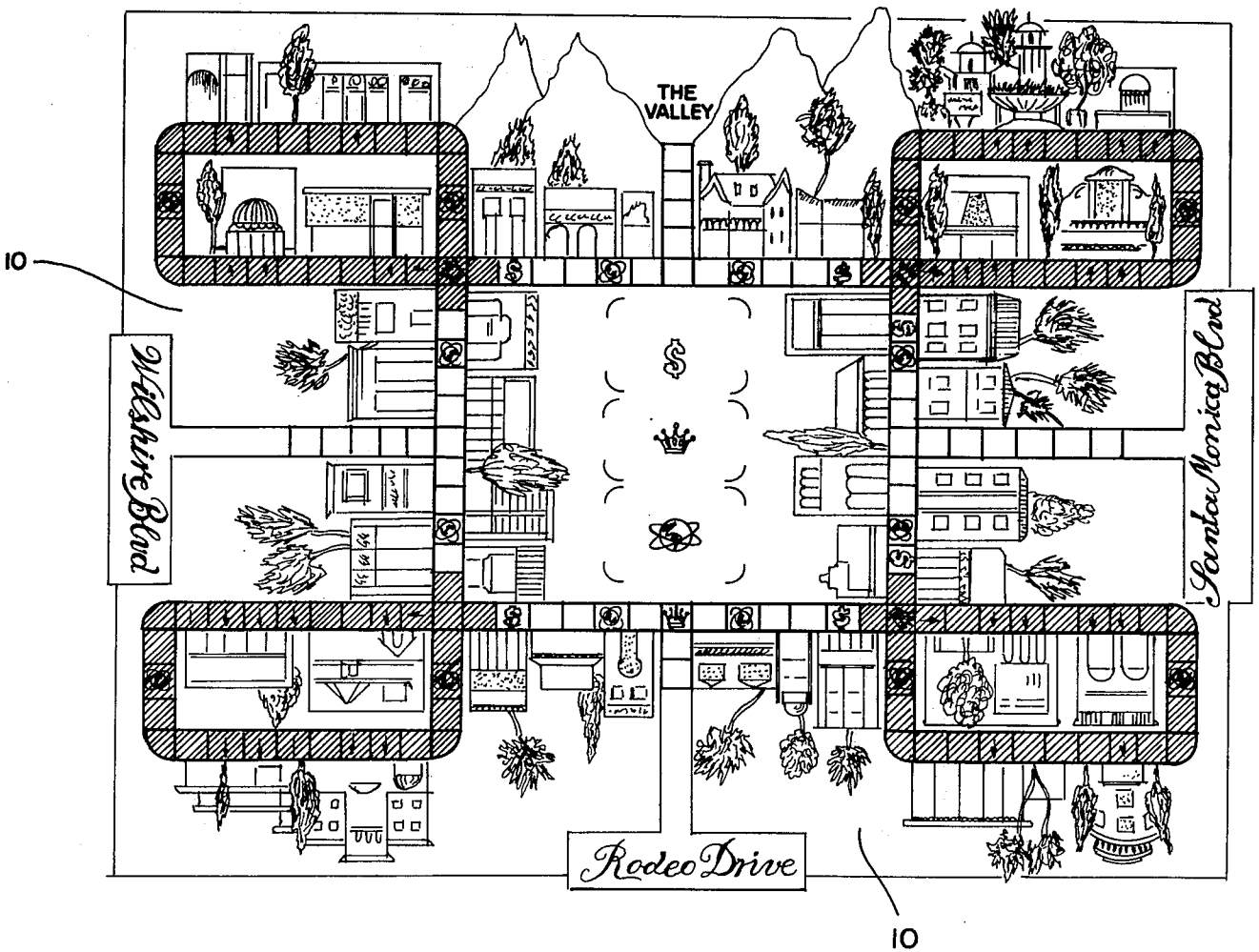
FIG. 1 is a plan representation of the board of the invention, in accordance with one embodiment.

The game board 10, as shown in FIG. 1, has marked squares which form a path extending around the board. Loops at each corner constitute Gold Street areas in which the squares are shown cross-hatched. The path is intended to represent locations in Beverly Hills, for example, hotels, restaurants and exclusive retail stores line each side of the streets, each store being identified by a different name of a well-known retail establishment.

There are three entrances to the streets of Beverly Hills, these being designated respectively as "Santa Monica Boulevard", "Wilshire Boulevard" and "Rodeo Drive", these being streets in Beverly Hills in increasing order of status level. There is also an exit from the streets to "The Valley", which represents the San Fernando Valley suburb of Los Angeles, and which is representative for the purposes of the game to be on a relatively low social level.

Figure 2:
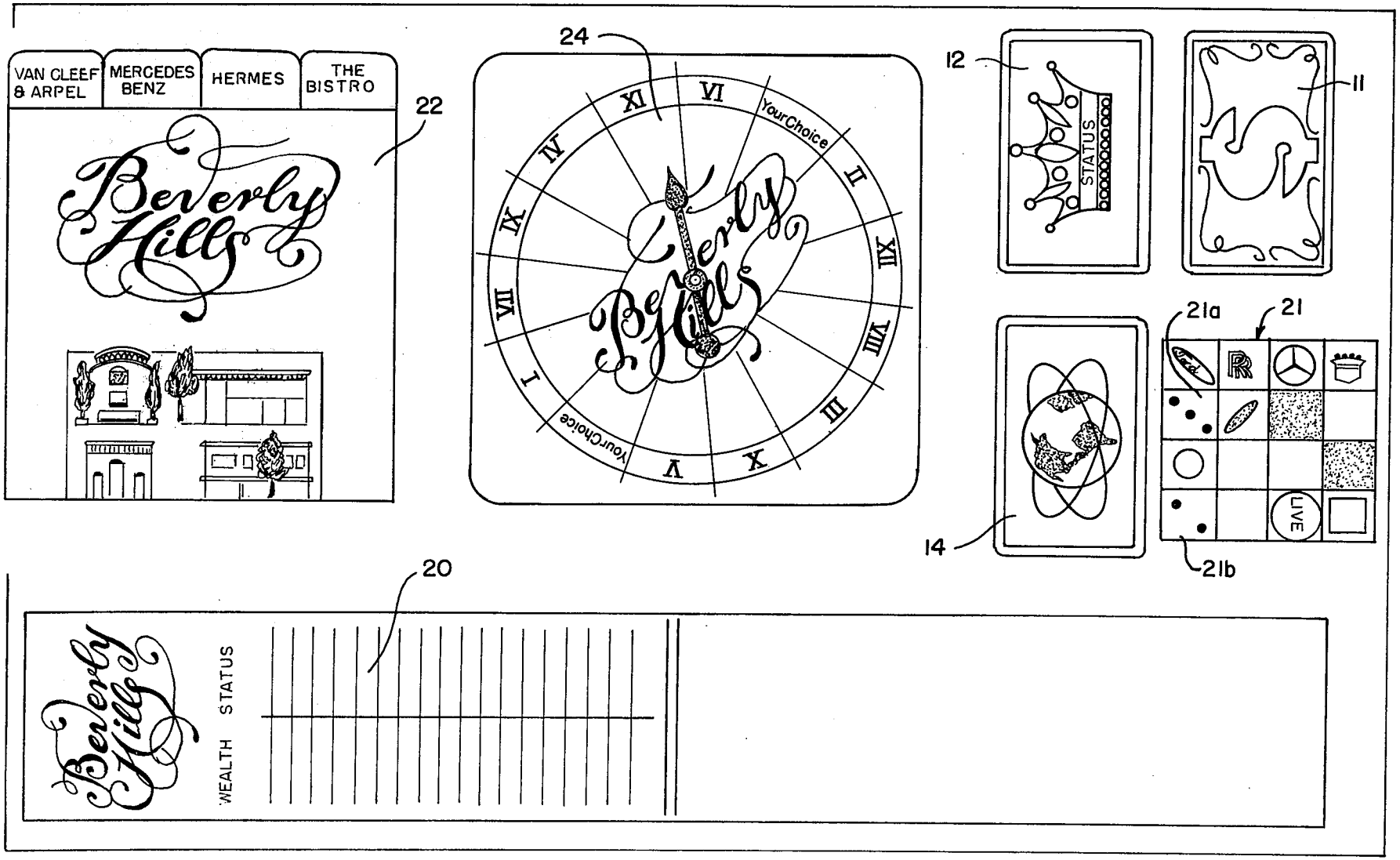
FIG. 2 is a representation of a collection of items which are used in playing the game.

Certain of the squares on the board 10 are marked with a crown symbol, and when a player's game piece lands on such a square, he selects a "Status" card from a deck (FIG. 2). Other squares are marked with a globe symbol, and when a player's game piece lands on such a square, he selects a "Jet Set" card 14 from a deck (FIG. 2). Still further squares are marked with a dollar symbol, and when a player's game piece lands on such a square, he selects a "Bank" card 16 from a deck (FIG. 2).

Figure 3:
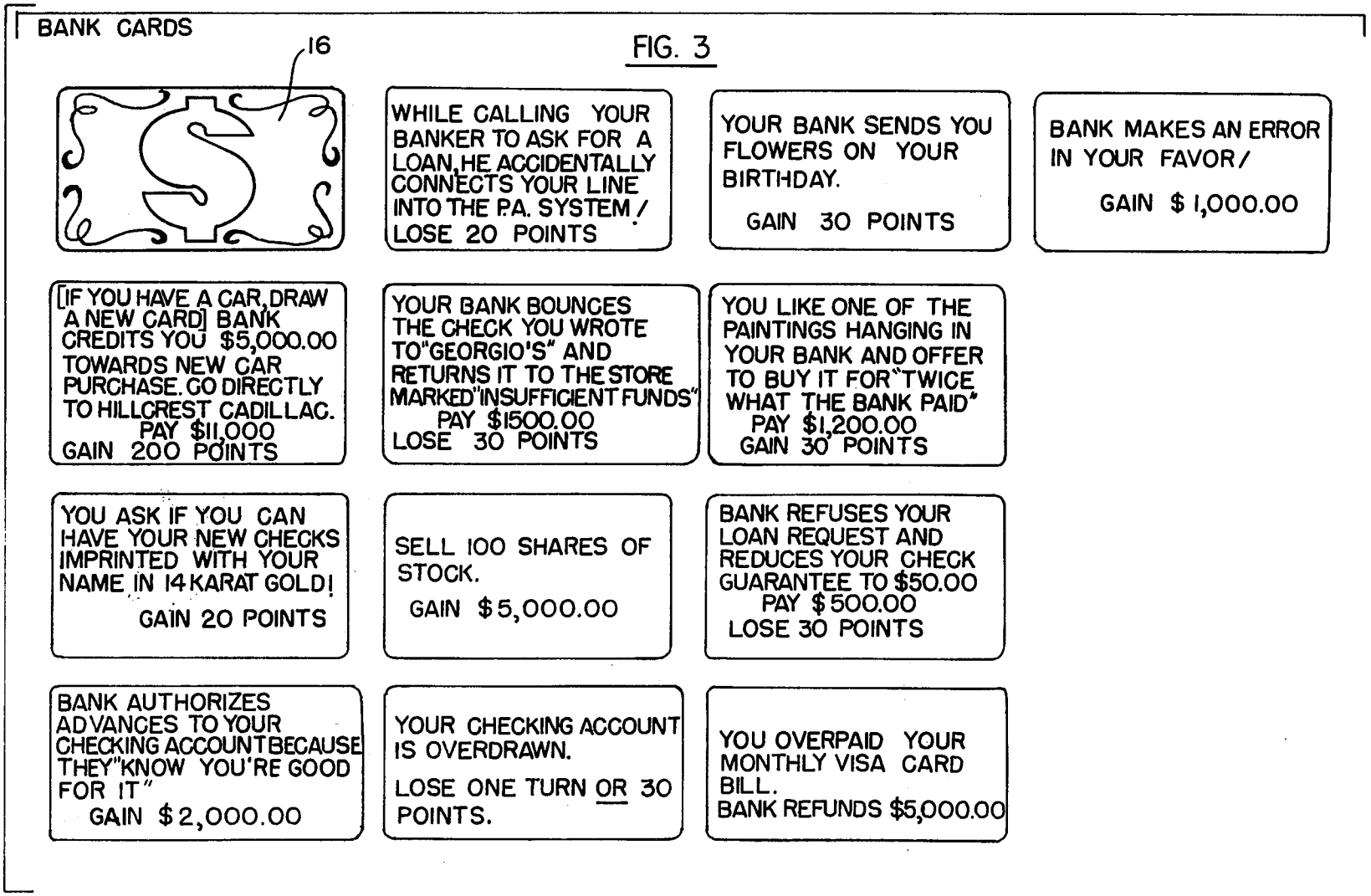
FIG. 3 is a collection of Bank cards, with representative instructions appearing on the cards.
Figure 4:
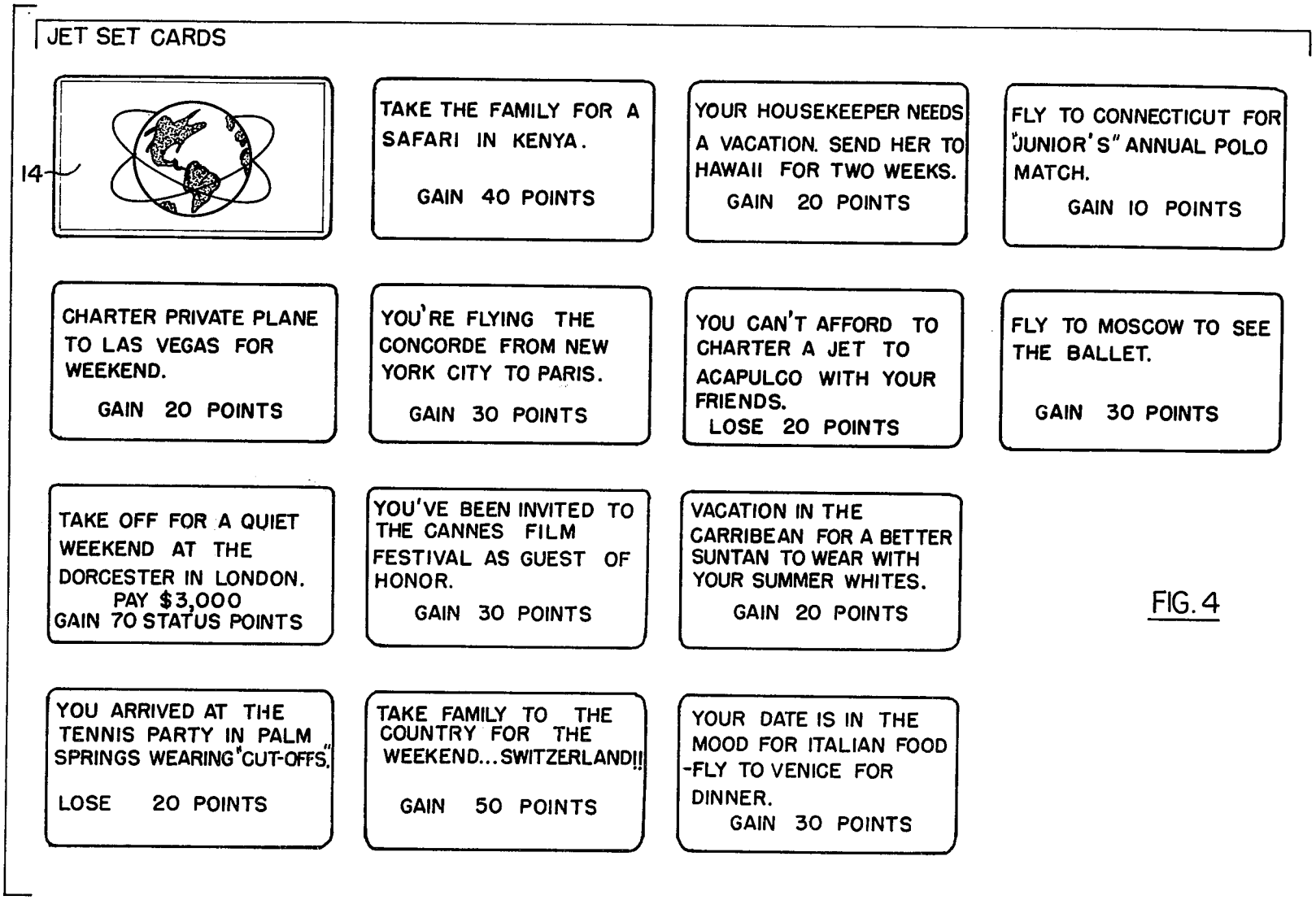
FIG. 4 is a collection of Jet Set cards, with typical instructions appearing on such cards.

The Bank card 16 contains certain messages and designates certain status point gains or losses, as shown in FIG. 3. Likewise, the Jet Set cards 14 contain certain messages and designate certain status point gains or losses, as shown in FIG. 4. The Status cards 12, themselves, contain certain messages and designate certain status point gains or losses, as shown in FIG. 5.

As shown in FIG. 2, each player is provided with a score sheet 20 on which a running tally of his wealth and status is kept.

When a player's game piece lands on a space adjacent to one of the hotels, restaurants or stores in the Gold Street area, he is presumed to have entered the particular establishment. The player then spins the needle on a status wheel 24 which may stop at a particular number. The player then refers to a page in a booklet 22 carrying the name of the particular establishment he has entered, and to the number on the page corresponding to the number indicated by the status wheel needle, to determine what purchase he will make in the particular store.

A number of booklets 22 may be provided and the pages may be set up as follows:

GUCCI/$2500.00

(2) Purchase a Gucci briefcase. Pay $500.00 and Gain 100 points.
(3) You just asked if they had any belt buckles with your initials instead of the two "G"'s. Lose 30 points.
(4) You remark to the salesperson how you've always admired French leather works. Lose 20 points.
(5) After buying a matching desk set, you remark, "I do hope this color goes well in the maid's room". Pay $1000.00 and gain 30 points.
(6) You ask for a Gucci dog collar. Gain 20 points.
(7) As a "special customer" you are offered the golden key to "La Galeria", free of charge. Gain 40 points.
(8) Purchase 7 pairs of shoes—one color for each day of the week. Gain 40 points, but pay $1000.00
(9) The doorman abruptly bodychecks 20 patrons to clear the way for your entrance. Gain 20 points.
(10) When asked why you are buying 12 Gucci scarves you reply that they wear out easily since you use them as shoe buffers. Gain 20 points.
(11) While buying a wallet you attempt to "bargain" with the sales clerk. Lose 30 points.
(12) After entering, you say—again in your loud voice—"So this is Guck-eye!" Lose 30 points.

DAISY/$100.00

(2) You just ordered a "Chili-Size". Lose 10 points.
(3) You've been seated next to Robert Redford. Gain 50 points.
(4) Again, in your loud voice, you ask "What's Perrier Water?" Lose 10 points.
(5) You arrive for lunch wearing your tennis togs. Gain 10 points.
(6) You're asked if the Daisy may use your name on the Menu for their latest dish. Gain 30 points.
(7) You are ushered ahead of waiting customers and seated at the center table on the sidewalk patio. Gain 20 points.
(8) For publicity, you are offered a lifetime membership in the Daisy's nightclub. Gain 20 points.
(9) Upon arrival, you are immediately offered a table in the alley. Lose 20 points.
(10) Upon arrival, you are offered complimentary champagne. Gain 10 points.
(11) Again in your loud voice—but this time in French—you ask the owner, "How's business". Gain 10 points.
(12) Upon arrival you are asked beside which star you wish to be seated. Gain 20 points.

TED LAPIDUS/$150.00

(2) You ask if they have a "lay-away" plan. Lose 20 points.
(3) Buy a pair of "Kick-around jeans". Pay $100 and Gain 20 points.
(4) Purchase a new "casual outfit". Pay $600.00 and Gain 60 points.
(5) While surrounded by customers, you ask when the next "White Sale" starts. Lose 20 points.
(6) Purchase a "cute", cotton tee shirt. Pay $100.00 and gain 20 points.
(7) When they offer to show you the "latest designs" you say you already saw them at the "Paris Fashion Debut". Gain 30 points.
(8) When asked if you are interested in "seeing anything", you reply, "Yes, if it cost a lot!" Gain 30 points.

(9) You are caught sneaking a look at a price tag! Lose 20 points.
(10) When asked if you like their new designs you say, "Yes, I've been looking for some lounging clothes"! Gain 30 points.
(11) You leave a tip for the cashier. Gain 10 points.
(12) Again, in your loud voice, you tell the cashier, "Just bill my estate"! Gain 20 points.

BEVERLY WILSHIRE/$100.00

(2) Just as you're about to enter, the doorman stops you to ask if you're lost. Lose 10 points.
(3) While dining at the El Padrino, you order the McCarthy Salad without beets. Gain 20 points.
(4) You tell the Maitre d' that he reminds you of a dead perch. Gain 10 points.
(5) For a private luncheon, the Hotel offers you the "Christian Dior Suite" free of charge. Gain 50 points.
(6) After having one too many at the bar, you remark, "Wait till the gang back in Bakersfield hears about this place!" Lose 20 points.
(7) The Captain asks if you would like the seafood bar brought to your table. Gain 10 points.
(8) You invite 30 people to dine with you in the Belle Fontan Room. Gain 30 points.

BROWN DERBY/$70.00

(2) You just asked the Captain if corn was included with your "Cobb Salad". Lose 10 points.
(3) In a loud voice you tell the Captain "Bring me the usual". Gain 20 points.
(4) You ask the waiter if the tip is included. Lose 10 points.
(5) The Captain asks you if you'll be needing a phone at your booth. Gain 10 points.
(6) An "old friend" converges on your table, wearing a double knit suit and carrying a vinyl bag. Lose 20 points.
(7) You are overheard discussing your latest investment in Iranian Oil. Gain 20 points.
(8) You send back the bottle of wine they bring you because it is "not a good year". Gain 10 points.
(9) Upon finishing your lunch, the Captain inquires whether he should call your limo. Gain 30 points.
(10) A "friend" asks in a loud voice how long it took you to recover from your face lift. Lose 30 points.
(11) The Maitre d' brings extra flowers to your table. Gain 20 points.
(12) The owner asks if they may include your caricature in their Gallery of Stars. Gain 40 points.
ALTERNATE: You are quitely ushered to a cramped table near the door.

BEVERLY HILLS HOTEL/$200.00

(2) So you shant be disturbed, the hotel refuses to rent any bungalows near yours! Gain 40 points.
(3) You ask waiter what "Poulet" is. Lose 20 points.
(4) Rona Barrett takes you to lunch for a quick interview. Gain 20 points.
(5) You're given a table without a telephone jack. Lose 20 points.
(9) Without requesting it, the Hotel has reserved for you the best poolside cabana. Gain 50 points.
(10) Ask waiter if he validates parking. Lose 20 points.
(11) You're overheard requesting a "private" booth so as not to be bothered by possible press. Gain 40 points.
(12) After lunch, Maitre d' personally escorts you back to your room. Gain 30 points.

GIORGIO'S/$400.00

(2) The bartender spots you and prepares your drink as you enter the store. Gain 30 points.
(3) You have your friend take a picture with your Instamatic of you going in. Lose 20 points.
(4) Your autographed 8×10 glossy hangs behind the cashier. Gain 50 points.
(5) Purchase entire wardrobe for your next trip and take a JET SET card. Gain 100 points.
(6) Ask bartender for a "Waikiki Woo-Woo". Lose 20 points.
(7) You ask when the "white sale" starts. Lose 40 points.
(8) You're invited to try on a mink lined cashmere coat. Gain 40 points.
(9) Purchase silk 3 piece suit and have tailor embroider your initials on each piece. Gain 40 points.
(10) While trying on silk evening suit, you ask clerk if it's "Machine wash-tumble dry". Lose 30 points.
(11) Shopping with a $1000 gift certificate! Purchase 2 silk shirts and a scarf. Gain 40 points.
(12) You like complete privacy when you shop. Store closes to public as you enter. Gain 100 points.

HERMES/$500.00

(2) Purchase the classic Hermes scarf. Pay $200.00 but gain 20 points.
(3) Decide to pick up another of those charming bags with the "H" clasp—Pay $500.00 but gain 40 points.
(4) Ask for a clutch bag with a "B" instead of an "H". Lose 30 points.
(5) Time for a trip—buy a new suitcase. Spend $1000. Gain 50 points.
(6) No one waits on you so you ask to speak to "Hermie". Lose 20 points.
(7) Greet sales staff in perfect French. Gain 30 points.
(8) Tell them you always shop at their Valley Store. Lose 30 points.
(9) You simply have to have the item on display in the window. Tell them to write it onto your account. Gain 50 points.
(10) You're asked to model new line for Fall. Gain 40 points.
(11) It begins to drizzle while waiting for valet to get your car. Run in and buy Hermes umbrella. Gain 30 points.
(12) Spend $200 on Hermes belt. Gain 20 points.

BISTRO/$200.00

(2) You've rented the place out for a private party. Gain 90 points.
(3) Tell Doorman "No thanks, we're just lookin'" Lose 10 points.
(4) PA announces "Lights left on in a new Stutz with solid gold interior". Walk out with slow dignity and keys dangling Gain 50 points.
(5) During Captain's recitation of "daily specials" you correct his French pronunciation . . . 3 times. Gain 20 points.
(6) Ask waiter if you could please have the English menu translation. Lose 20 points.
(7) Dining with the Senator again . . . request best table. Gain 20 points.
(8) Ask waiter if he could please split the tab up amongst the 6 of you. Lose 30 points.

(9) Ask Captain for 4 doggie bags with all leftovers. Lose 20 points.
(10) Order loudly—"Give me your best Bordeauz Charles". Gain 30 points.
(11) Before ordering, the chef consults with you and your party personally. Gain 40 points.
(12) Send the wine back, complaining to Steward that you requested '59 not '60.

BEVERLY HILLS MERCEDES/$3,000.00

3-7-11-4-8

Because you're trading last years Rolls in on a new 6.9 Mercedes, the dealer advances you credit of $39,000; if you come up with $10,000 . . . drive it away. Gain 200 points.

2

You have been chosen "Man of the Year" and have been awarded a new 450 SLC. Gain 200 points.

5-9

If you buy, you must pay retail for one 300 Diesel. Pay $24,000 and gain 200 points.

12-6-10

Buy a new 450 SEL. Bank allows you credit of $20,000. Pay remaining $13,000. Gain 200 points.

NATE 'N AL'S/$50.00

(2) After ordering Lox and Bagels, you change your order to a bologna with mayo. Lose 10 points.
(3) On Sunday morning, you hog a large booth by reading the entire L.A. Times after breakfast. Gain 10 points.
(4) Sammy Cahn comes over to your table and composes a breakfast song just for you. Gain 20 points.
(5) When your waitress brings you a bagel, you quip "That's all right, I'll go to Panama for the lox." Lose 10 points.
(6) Your name is paged along with Paul Newman's. Gain 20 points.
(7) You order Matzo Ball Soup and read the Daily Variety Aloud. People think you're a Producer. Gain 20 points.
(8) When you enter, every eye in the place turns to you and a few even wink. Gain 10 points.
(9) When the waitress comes to take your order you give it in fluent Hebrew. Gain 20 points.
(10) While you eat, your dog leashed to the newstand outside pulls it over causing it to crush the hood of a new Porsche. Lose 20 points.

BEVERLY HILLS ROLLS ROYCE/$4,000

4-8-3-7-11

Bank advances you $30,000 toward the purchase of a new Rolls Silver Shadow. You must cough up additional $15,000. Gain 250 points.

2

Because of your reputation, Beverly Hills Rolls Royce allows you to drive a Corniche free for one year. Gain 250 points.

5-6

You buy used Rolls which a rich high schooler has been using as his hot rod. Pay $6,000 and Gain 50 points.

9-10-12

Bank advances $25,000 towards purchase on new Rolls. You pay $7000.00. Gain 250 points.

HILLCREST CADILLAC/$2000.00

(2) Because of your generosity in the Israeli Bond drive, you've been awarded one new Cadillac. Gain 170 points.

4-5-11

You may purchase one Cadillac at retail—$17,000. Gain 170 points.

3-8-10-6-12

Bank will advance you down payment of $5000. You must pay $12,000. Gain 170 points.

7-9

You may buy old Second-hand Caddie off the Used Car Lot. Pay $1500. and Gain 40 points.

SAKS/PAY $250.00

(2) As you walk in—two salespeople drop their customers to greet you. Gain 20 points.
(3) When the sales clerk offered to have your purchases carried to your Limousine, you admitted you didn't have one. Lose 20 points.
(4) Sales clerk in designer salon asks if you've seen the new Halston line—you ask "Who's that?" Lose 20 points.
(5) Purchase Fur cape for your pet Shihtzu. Pay $150.00 and Gain 30 points.
(6) Clerk in Designer's Salon informs you that De La Renta has designed a suit for you. Gain 30 points.
(7) Store manager knows your reputation from your New York shopping sprees. He welcomes you with open arms. Gain 30 points.
(8) While sampling at cosmetic counter . . . you ask clerk if they carry economy size toilet water. Lose 20 points.
(9) You're seen purchasing in jewelry department with your personal insurance agent and armed guard. Gain 30 points.
(10) You bring your Chaufeur shopping to help carry those cumbersome packages. Gain 30 points.
(11) Clerk checks on your charge account and has to deny you your purchase as your "credit is limited." Lose 30 points.
(12) You have your own dressing room reserved for you—with divan, bar and 8-way mirrors. Gain 30 points.

Briefly stated, the object of the game of the present invention is to accumulate status. This is achieved, for example, by trading up from a Ford to a Rolls Royce, Mercedes or Cadillac; by dining at the "right" restaurants, by spending extravagantly, and so on.

In accordance with particular rules which are set forth herein by way of example, each player starts with a credit line of $25,000.00. Credit rather than cash is provided at the outset since to provide the players with cash would be considered vulgar. Each player also starts with zero status points. The winner is the first player to accumulate 500 status points, for example, with at least $10,000.00 remaining in his credit account.

At the outset, each player is provided with a cube from the cubes 21 shown in FIG. 2, which represents his or her initial car, namely, a Ford. However, during the course of the game, as described above, the player may trade in his non-status car for a status car represented, for example, by a cube with the Rolls Royce, Mercedes, Cadillac, insignia thereon.

The player is governed primarily by rolling the dice 21*a*, 21*b* shown in FIG. 2. Anyone rolling a "9" or better, enters from Rodeo Drive, by moving his game piece the number of squares indicated by the numbers on the dice. Anyone rolling between "5" and "8" enters from Wilshire Boulevard, and anyone rolling a "4" or less must enter from Santa Monica Boulevard.

Upon reaching the "street" on the game board, each player may proceed in either direction. This holds true for all rolls while the game piece is on the squares which are not cross-hatched, that is, outside a Gold Street area. Although any direction may be selected, each move is limited to one direction only.

Each time the game piece lands on a square with a crown symbol, the player picks up a Status card 12, and reads aloud the message on his Status card. He then follows any instructions which may be given by the Status card, and also enters his score sheet the plus or minus status points corresponding to that card, as shown in FIG. 5.

Likewise, each time a game piece lands on a square bearing the globe symbol, the player picks up a Jet Set card 14, and reads aloud the message on the card, as shown in FIG. 4, and also adds or deducts the status points indicated by the card.

Moreover, whenever a game piece lands on a square having a dollar sign, the player picks up a Bank card 16, reads aloud the message on the Bank card, as shown in FIG. 3, and adds or subtracts the designated number of status points from his score.

To enter any one of the Gold Street locations at each corner of the board 10, whose squares are shown cross-hatched, a player's game piece must land on one of the three entry squares located at the entrance of each Gold Street area. While on a Gold Street square (cross-hatched in FIG. 1) direction of play is limited to one direction indicated by the arrow. Only one die is used to control the progress of a game piece along a gold area street.

To enter any one of the exclusive establishments in the Gold Street area, a player's game piece must land on a square in front of the particular establishment which contains an arrow pointing in the direction of the store, and an entry fee of, for example, $100.00 (or other amount designated on the corresponding one of Booklets 22) must be paid. If a player does not wish to enter the establishment, he need not. In that event, no entry fee is paid.

Upon paying the entry fee for a particular establishment, the player then spins the needle on the Status Wheel 24. If the needle stops on a number, the player refers to the number in booklet 22 on the page corresponding to the particular establishment to determine what purchase in the particular establishment is to be made. If the needle stops at "Your Choice", the player may spin again for a number, or he may move to any other establishment in the same Gold Street area and "enter" that establishment without having to pay an entry fee. A player may remain in any particular establishment in the Gold Street area up to three consecutive turns and for each turn he spins the needle on Status Wheel 24. However, on the fourth turn he must exit.

To remain in a particular Gold Street area by recircling and without exiting, one must roll a number which will cause his game piece to land exactly on the gold entry square marked with a crown in FIG. 1. If any other number is rolled, the player must exit accordingly, and wait until his next turn to attempt to re-enter.

To purchase a car, a player must "enter" one of the car dealerships in the Gold Street area, and the procedure is the same as that described above for "entry" of any other retail establishment. However, a player can remain in a car dealership for one turn only. A player subsequently can enter another dealership and trade his car for a higher status car. The amount paid for the original car can be deducted from the purchase price of his new car. Also, the status points acquired from the purchase of the original car must be deducted from the purchaser's total score. On his turn, any player may offer to sell his car to another player, or to purchase a car from another player. In either case the purchase price is open to negotiation. If a deal is made, the purchaser acquires the same number of status points as the seller originally received for the status car, but no status points are deducted from the score of the seller. An offer to buy or sell a status car does not constitute a turn, but if a deal is made, this does constitute the end of the particular player's turn.

A player can be forced to the "Vallye" by: (a) being "bumped" by another player who lands on the same square originally occupied by the first player. However, no player can be "bumped" from inside a Gold Street area; (b) by losing so many status points that a player enters a negative status position, for example, −10, −20, etc.; or (c) by drawing a card which directs a player to the Valley. To get out of the Valley, the player must roll at least 5 with both dice and move the number of squares rolled. If a player rolls less than 5, he stays in the Valley until his next turn and tries again.

The foregoing description, of course, is merely an example of the particular rules by which the game of the invention may be played. However, it is obvious that the game may also be played in accordance with other rules. It is obvious, therefore, that although a particular embodiment of the invention has been shown and described, modifications may be made. It is intended in the claims to cover the modifications which come within the spirit and scope of the invention.

What is claimed is:

1. A game board combination including: a game board having marked squares thereon constituting a path extending around the board, said path constituting a continuous course for purposes of continuity of play and simulating a street, said game board further having marked representations carrying the names of different exclusive retail establishments adjacent to the street simulated by the aforesaid path, certain of said squares designating an entry into the respective establishments, a catalog having pages identified by the names of the aforesaid exclusive establishments and having a list of service or products sold by the esetablishments on the respective pages, game pieces, dice means for determining the progression of the game pieces along the path from square to square, and a spinner for identifying the goods and services listed in said catalog on the page of the particular establishment entered by any one of said game pieces to determine the particular purchase to be made in the particular establishment by said game piece.

2. The game board combination defined in claim 1, in which portions of the path represent particularly designated areas, with representations of selected ones of the establishments being positioned adjacent to the path in the particularly designated areas.

3. The game board combination defined in claim 1, and which includes a deck of cards, each with a particular message thereon, and certain of the squares of the path having a selected symbol thereon designating that one of the cards is to be selected from the deck.

4. The game board combination defined in claim 1, and which includes a deck of Status cards, each with a particular message thereon, and certain ones of the squares of the path having a selected symbol thereon designating that one of the Status cards is to be selected from the deck.

5. The game board combination defined in claim 1, and which includes a deck of Jet Set cards, each with a particular message thereon, and certain ones of the squares of the path having a selected symbol thereon designating that one of the Jet Set cards is to be selected from the deck.

6. The game board combination defined in claim 1, and which includes a deck of Bank cards each with a particular message thereon, and certain ones of the squares of the path having a selected symbol thereon designating that one of the Bank cards is to be selected from the deck.

7. The game board combination defined in claim 1, in which certain ones of the game pieces contain the insignia of known motor cars thereon.

* * * * *